US010125979B2

(12) United States Patent
Colannino et al.

(10) Patent No.: US 10,125,979 B2
(45) Date of Patent: Nov. 13, 2018

(54) COMBUSTION SYSTEM AND METHOD FOR ELECTRICALLY ASSISTED START-UP

(71) Applicant: ClearSign Combustion Corporation, Seattle, WA (US)

(72) Inventors: Joseph Colannino, Bellevue, WA (US); Douglas W. Karkow, Des Moines, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 398 days.

(21) Appl. No.: 14/787,144

(22) PCT Filed: May 12, 2014

(86) PCT No.: PCT/US2014/037743

§ 371 (c)(1),
(2) Date: Oct. 26, 2015

(87) PCT Pub. No.: WO2014/183135

PCT Pub. Date: Nov. 13, 2014

(65) Prior Publication Data

US 2016/0091200 A1 Mar. 31, 2016

Related U.S. Application Data

(60) Provisional application No. 61/822,201, filed on May 10, 2013.

(51) Int. Cl.
*F23C 99/00* (2006.01)
*F23Q 7/22* (2006.01)
(Continued)

(52) U.S. Cl.
CPC ..... *F23C 99/001* (2013.01); *F23N 5/203* (2013.01); *F23N 5/242* (2013.01); *F23Q 3/008* (2013.01); *F23Q 7/22* (2013.01); *F23C 99/008* (2013.01)

(58) Field of Classification Search
CPC ..... F23D 14/74; F23D 14/02; F23D 11/42; F23D 11/448; F23D 14/26; F23D 14/14;
(Continued)

(56) References Cited

U.S. PATENT DOCUMENTS 2,604,936 A 7/1952 Kaehni et al.
3,008,513 A 11/1961 Holden
(Continued)

FOREIGN PATENT DOCUMENTS

EP 0844434 5/1998
EP 1139020 8/2006
(Continued)

OTHER PUBLICATIONS

F. Altendorfner et al., Electric Field Effects on Emissions and Flame Stability with Optimized Electric Field Geometry, The European Combustion Meeting ECM 2007, 2007, Fig. 1, Germany.
(Continued)

*Primary Examiner* — Alfred Basichas
(74) *Attorney, Agent, or Firm* — Christopher A. Wiklof; David Conlee; Launchpad IP, Inc.

(57) ABSTRACT

A combustion system includes a combustion fluid charge source and a start-up flame holder configured to attract the charge and hold a flame when the combustion system is cool and allow the flame to lift when the combustion system is warmed up.

45 Claims, 8 Drawing Sheets

(51) Int. Cl.
*F23Q 3/00* (2006.01)
*F23N 5/20* (2006.01)
*F23N 5/24* (2006.01)

(58) Field of Classification Search
CPC ..... F23D 11/446; F23D 11/02; F23D 11/383; F23D 11/406; F23D 11/38; F23N 1/00; F23N 1/02; F23N 5/00; F23N 1/002; F23N 5/265; F23C 6/042; F23C 9/06; F23C 99/001; F23L 7/007
See application file for complete search history.

(56) References Cited

U.S. PATENT DOCUMENTS 3,076,605 A 2/1963 Holden
3,087,472 A 4/1963 Yukichi
3,167,109 A 1/1965 Wobig
3,224,485 A 12/1965 Blomgren, Sr. et al.
3,228,614 A 1/1966 Bauer
3,306,338 A 2/1967 Wright et al.
3,358,731 A 12/1967 Donnelly
3,416,870 A 12/1968 Wright
3,749,545 A 7/1973 Velkoff
3,841,824 A 10/1974 Bethel
4,020,388 A 4/1977 Pratt, Jr.
4,021,188 A 5/1977 Yamagishi et al.
4,052,139 A 10/1977 Paillaud et al.
4,081,958 A 4/1978 Schelp
4,111,636 A 9/1978 Goldberg
4,397,356 A 8/1983 Retallick
4,408,461 A 10/1983 Bruhwiler et al.
4,430,024 A 2/1984 Guild et al.
4,588,373 A 5/1986 Tonon et al.
4,673,349 A 6/1987 Abe et al.
4,726,767 A * 2/1988 Nakajima ..... A45D 20/06 126/401
4,752,213 A 6/1988 Grochowski et al.
4,773,847 A 9/1988 Shukla et al.
5,235,667 A 8/1993 Canfield et al.
5,248,255 A 9/1993 Morioka et al.
5,326,257 A 7/1994 Taylor et al.
5,441,402 A 8/1995 Reuther et al.
5,511,516 A 4/1996 Moore, Jr. et al.
5,515,681 A 5/1996 DeFreitas
5,641,282 A 6/1997 Lee et al.
5,702,244 A 12/1997 Goodson et al.
5,784,889 A 7/1998 Joos et al.
5,899,686 A 5/1999 Carbone et al.
6,159,001 A 12/2000 Kushch et al.
6,247,921 B1 6/2001 Helt
6,887,069 B1 5/2005 Thornton et al.
7,137,808 B2 11/2006 Branston et al.
7,159,646 B2 1/2007 Dessiatoun et al.
7,243,496 B2 7/2007 Pavlik et al.
7,360,506 B2 4/2008 Shellenberger et al.
7,523,603 B2 4/2009 Hagen et al.
7,845,937 B2 12/2010 Hammer et al.
7,927,095 B1 4/2011 Chorpening et al.
8,245,951 B2 8/2012 Fink et al.
8,851,882 B2 10/2014 Hartwick et al.
8,881,535 B2 11/2014 Hartwick et al.
8,911,699 B2 12/2014 Colannino et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,190 B2 6/2016 Karkow et al.
9,377,195 B2 6/2016 Goodson et al.
9,388,981 B2 7/2016 Karkow et al.
2002/0092302 A1 7/2002 Johnson et al.
2003/0203245 A1 10/2003 Dessiatoun et al.
2004/0081933 A1 4/2004 St. Charles et al.
2005/0208442 A1 9/2005 Heiligers et al.
2005/0208446 A1 9/2005 Jayne
2006/0141413 A1 6/2006 Masten et al.
2006/0156791 A1 7/2006 Tikkanen et al.
2006/0165555 A1 7/2006 Spielman et al.
2007/0020567 A1 1/2007 Branston et al.
2007/0048685 A1 3/2007 Kuenzler et al.
2007/0186872 A1 8/2007 Shellenberger et al.
2008/0268387 A1 10/2008 Saito et al.
2010/0183424 A1 7/2010 Roy
2011/0072786 A1 3/2011 Tokuda et al.
2011/0203771 A1 8/2011 Goodson et al.
2012/0164590 A1 6/2012 Mach
2013/0004902 A1 1/2013 Goodson et al.
2013/0071794 A1 3/2013 Colannio et al.
2013/0170090 A1 7/2013 Colannino et al.
2013/0230810 A1 9/2013 Goodson et al.
2013/0260321 A1 10/2013 Colannino et al.
2013/0291552 A1 11/2013 Smith et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0248566 A1 9/2014 Krichtafovitch et al.
2014/0255855 A1 9/2014 Krichtafovitch
2014/0255856 A1 9/2014 Colannino et al.
2014/0272731 A1 9/2014 Breidenthal et al.
2014/0287368 A1 9/2014 Krichtafovitch et al.
2014/0295094 A1 10/2014 Casasanta, III
2014/0295360 A1 10/2014 Wiklof
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0226424 A1 8/2015 Breidenthal et al.
2015/0241057 A1 8/2015 Krichtafovitch et al.
2015/0276211 A1 10/2015 Colannino et al.
2015/0276217 A1 10/2015 Karkow et al.
2015/0276220 A1 10/2015 Karkow et al.
2015/0285491 A1 10/2015 Karkow et al.
2015/0316261 A1 11/2015 Karkow et al.
2015/0330625 A1 11/2015 Karkow et al.
2015/0338089 A1 11/2015 Krichtafovitch et al.
2015/0345780 A1 12/2015 Krichtafovitch
2015/0345781 A1 12/2015 Krichtafovitch et al.
2015/0362178 A1 12/2015 Karkow et al.
2015/0369477 A1 12/2015 Karkow et al.
2016/0018103 A1 1/2016 Karkow et al.
2016/0025333 A1 1/2016 Karkow et al.

(56) References Cited

U.S. PATENT DOCUMENTS

| | | | |
|---|---|---|---|
| 2016/0033125 | A1 | 2/2016 | Krichtafovitch et al. |
| 2016/0040872 | A1 | 2/2016 | Colannino et al. |
| 2016/0123576 | A1 | 5/2016 | Colannino et al. |
| 2016/0138800 | A1 | 5/2016 | Anderson et al. |
| 2016/0161110 | A1 | 6/2016 | Krichtafovitch et al. |
| 2016/0161115 | A1 | 6/2016 | Krichtafovitch et al. |
| 2016/0215974 | A1 | 7/2016 | Wiklof |
| 2016/0230984 | A1 | 8/2016 | Colannino et al. |
| 2016/0245507 | A1 | 8/2016 | Goodson et al. |

FOREIGN PATENT DOCUMENTS

| | | |
|---|---|---|
| FR | 2577304 | 12/1989 |
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | 2001-021110 | 1/2001 |
| WO | WO 1995/000803 | 1/1995 |
| WO | WO 1996/001394 | 1/1996 |
| WO | WO 2013/181569 | 12/2013 |
| WO | WO 2015/038245 | 3/2015 |
| WO | WO 2015/042566 | 3/2015 |
| WO | WO 2015/042615 | 3/2015 |
| WO | WO 2015/051136 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |

OTHER PUBLICATIONS

Timothy J.C. Dolmansley et al., "Electrical Modification of Combustion and the Affect of Electrode Geometry on the Field Produced," Modelling and Simulation in Engineering, May 26, 2011, 1-13, vol. 2011, Himdawi Publishing Corporation.

James Lawton and Felix J. Weinberg. "Electrical Aspects of Combustion." Clarendon Press, Oxford. 1969, p. 81.

M. Zake et al., "Electric Field Control of NOx Formation in the Flame Channel Flows." Global Nest: The Int. J. May 2000, vol. 2, No. 1, pp. 99-108.

PCT International Search Report and Written Opinion of International PCT Application No. PCT/US2014/037743 dated Sep. 24, 2014.

James Lawton et al., Electrical Aspects of Combustion, 1969, p. 81, Clarendon Press, Oxford, England.

B. Stratton et al., "Determining Flame Height and Flame Pulsation Frequency and Estimating Heat Release Rate from 3D Flame Reconstruction." Fire Engineering Research Report 05/2, Dept. of Civil Engineering, Univ. of Canterbury, Christchurch, New Zealand, Jul. 2005, 90 pages.

* cited by examiner

COMBUSTION SYSTEM AND METHOD FOR ELECTRICALLY ASSISTED START-UP

CROSS REFERENCE TO RELATED APPLICATION

The present application is a U.S. National Phase application under 35 U.S.C. 371 of co-pending International Patent Application No. PCT/US2014/037743, entitled "COMBUSTION SYSTEM AND METHOD FOR ELECTRICALLY ASSISTED START-UP", filed May 12, 2014; which application claims the benefit of U.S. Provisional Patent Application No. 61/822,201, entitled "COMBUSTION SYSTEM AND METHOD FOR ELECTRICALLY ASSISTED START-UP", filed May 10, 2013; each of which, to the extent not inconsistent with the disclosure herein, is incorporated herein by reference.

SUMMARY

According to an embodiment, a combustion system includes a charge source configured to apply an electric charge to a combustion fluid and a start-up combustion holder configured to attract the electric charge and hold a flame when the combustion system is below a pre-determined temperature threshold and to not hold the flame when the combustion system is above the pre-determined temperature threshold. A holding voltage source may be operatively coupled to the start-up combustion holder and configured to substantially maintain the start-up combustion holder at a charge attracting voltage potential. A cooler may be operatively coupled to the start-up combustion holder.

The combustion system may be configured to support a combustion reaction when the combustion system is above the pre-determined temperature threshold. For example, a distal perforated flame holder can be configured to hold the combustion reaction when the combustion system is above the pre-determined temperature threshold.

According to an embodiment, a method for operating a combustion system, includes the steps of operating an electric charge source to apply electric charges to a combustion reactant, supporting a combustion reaction with the combustion reactant such that the combustion reaction carries the electric charges carried to the combustion reaction by the combustion reactant, and applying a holding voltage to a start-up combustion holder. The electric charges carried by the combustion reactant and combustion reaction are electrically attracted to the holding voltage carried by the start-up combustion holder such that the combustion reaction is held in a position proximate to the start-up combustion holder responsive to the attraction of the electric charges to the start-up combustion holder. In the start-up position, the combustion reaction can preheat a distally positioned perforated combustion reaction holder. After the perforated combustion reaction holder is preheated, the combustion reaction can be released from the start-up combustion holder.

According to an embodiment, a method for operating a combustion system, includes the steps of operating an electric charge source to apply electric charges to a combustion reaction, and applying a holding voltage to a start-up combustion holder. The electric charges carried by the combustion reaction are electrically attracted to the holding voltage carried by the start-up combustion holder such that the combustion reaction is held in a position proximate to the start-up combustion holder responsive to the attraction of the electric charges to the start-up combustion holder. In the start-up position, the combustion reaction can preheat a distally positioned perforated combustion reaction holder. After the perforated combustion reaction holder is preheated, the combustion reaction can be released from the start-up combustion holder.

DETAILED DESCRIPTION

Figure 1:
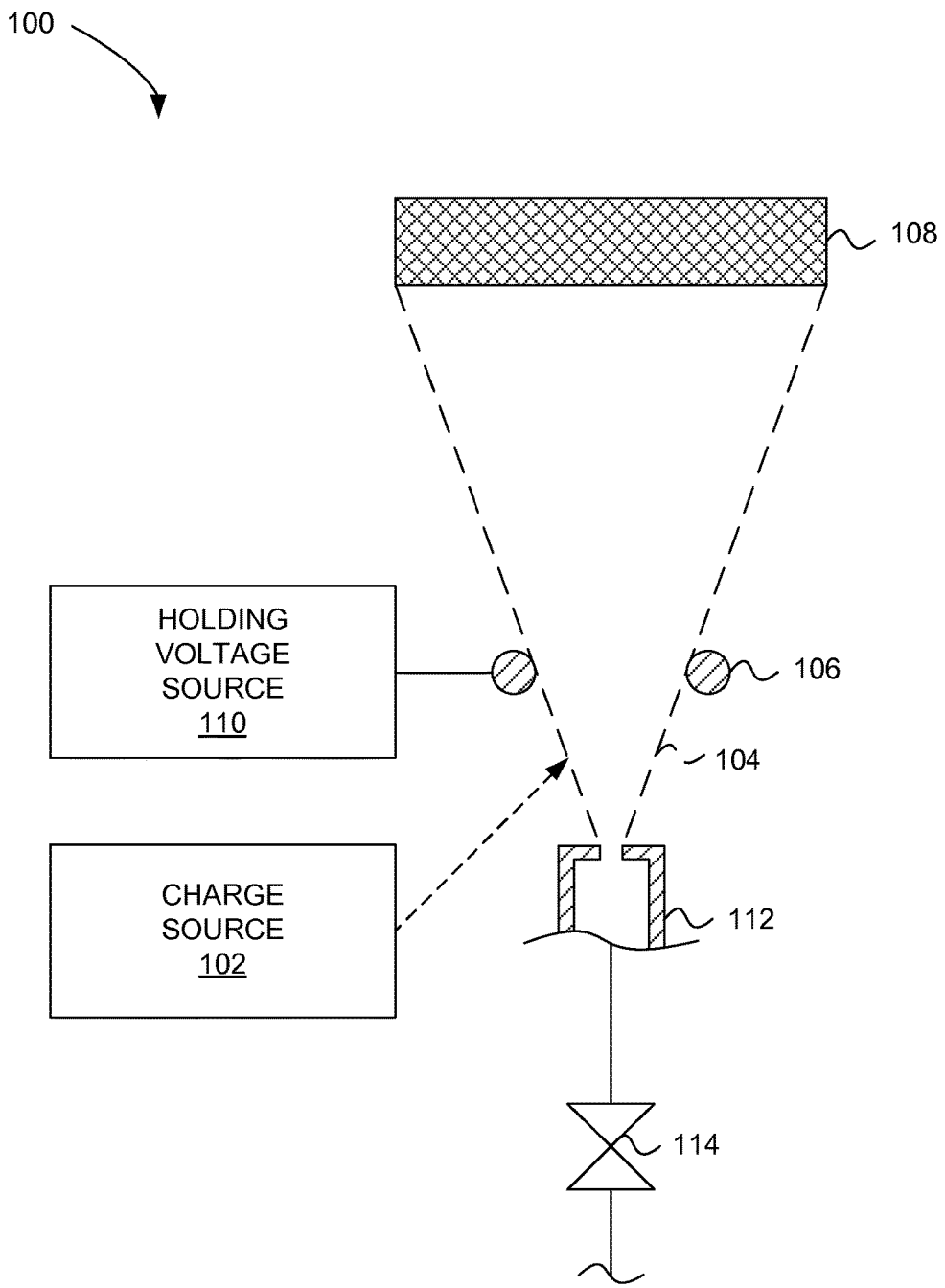
FIG. 1 is a diagram of a combustion system configured for electrically assisted start-up, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used and/or other changes may be made without departing from the spirit or scope of the disclosure.

FIG. 1 is a diagram of a combustion system 100 configured for electrically assisted start-up, according to an embodiment. The combustion system 100 includes a charge source 102 configured to apply an electric charge to a combustion fluid 104 and a start-up combustion holder 106 configured attract the electric charge and hold a flame when the combustion system 100 is below a pre-determined temperature threshold and to not hold the flame when the combustion system 100 is above the pre-determined temperature threshold.

Generally speaking, temperatures below the temperature threshold may correspond to system start-up or to system idle conditions. Temperatures above the temperature threshold correspond to normal operating temperatures of a combustion system (combustion chamber).

The combustion system 100 may be configured to support a flameless combustion reaction, may be certified to support a lifted position combustion reaction, and may be certified to support a low nitrogen oxide (NOx) output combustion reaction when the combustion system 100 is above the pre-determined temperature threshold.

Additionally or alternatively, a raised flame holder 108 may be configured to hold the combustion reaction when the combustion system 100 is above the pre-determined temperature threshold. The raised flame holder 108 can include a body defining a plurality of perforations extending through the body, a high temperature ceramic honeycomb, a cordierite honeycomb, an alumina honeycomb, and/or a ceramic honeycomb having channels of about 1.99 mm to 5 mm square sectional size. The raised flame holder 108 can include a honeycomb sheet having a thickness of about 0.5 inches to 4 inches. According to another embodiment, the raised flame holder 108 can include a honeycomb sheet having a thickness of about 2 inches.

As described above, temperatures above the temperature threshold correspond to normal operating temperatures of the combustion system peripheral to the flame holder(s). The predetermined temperature threshold may consist essentially of a system-specific rated combustion temperature above which 6-sigma or other flame stability reliability is certified for a combustion reaction not held by the start-up combustion holder 106. In other embodiments, the predetermined temperature threshold may consist essentially of a rating for a package burner or boiler model. Certification may be provided by a boiler or burner manufacturer, by a system certification engineer, or by a boiler or burner operator, for example. In some embodiments, the predetermined temperature threshold is a system control program value carried as data on a non-transitory computer-readable medium. According to an embodiment, a user interface includes a temperature threshold selector configured for selection by an operating engineer.

A cool combustion system 100 (at a temperature below the predetermined temperature threshold) may imply that the temperature of the system (including flue gas recycle, if any) is too low for combustion to be sustained reliably and/or too low for the combustion reaction to burn cleanly. In contrast, a "hot" combustion system 100 (at a temperature above the predetermined temperature threshold) may be generally regarded as being in at least a temporary steady state or pseudo steady state heat output within a specified turndown. In many combustion systems, a hot combustion system 100 can approach an adiabatic flame temperature minus a temperature difference corresponding to transfer of heat from the combustion reaction to a heat sink (such as steam tubes, a process, a heat exchanger, or shell.

The combustion fluid 104 can include a fuel stream, the flame, combustion air, and flue gas at various locations. As described above, the electric charge is added to the combustion fluid. In some embodiments, the electric charge is added to a particular fraction of the combustion fluid, and the charged fraction conveys the charge to the flame. In some embodiments, the electric charge is added at one or more particular locations and the fraction of the passing combustion fluid changes depending on flame position.

The combustion system 100 can include a holding voltage source 110 operatively coupled to the start-up combustion holder 106 and configured to substantially maintain the start-up combustion holder 106 at a charge attracting voltage potential. The holding voltage source 110 can include an electrical node corresponding to a voltage ground and a voltage source configured to output a voltage opposite in polarity from the electric charge applied to the combustion fluid 104. The holding voltage source 110 may be configured to hold the start-up combustion holder 106 at a voltage potential sufficient to hold the flame when the combustion system 100 is below the pre-determined temperature threshold.

An electronic controller (not shown) can be operatively coupled to the holding voltage source 110 and configured to control the holding voltage applied to the start-up combustion holder 106. A sensor (not shown) operatively coupled to the electronic controller and configured to sense a combustion volume attribute can be operatively coupled to the electronic controller. The electronic controller may be configured to control the voltage output by the charge voltage source to the charge source 102 responsive to feedback from the sensor. The sensor can include a temperature sensor. The electronic controller was found to be optional.

A fuel nozzle 112 can be configured to output a fuel stream (labeled 104 in FIG. 1). A fuel valve 114 can be operatively coupled to the fuel nozzle 112 and configured to control a flow of fuel. In one operating mode, the fuel valve 114 was configured to allow a fuel stream velocity from the fuel nozzle 112 insufficient to blow the flame off the start-up combustion holder 106 when the combustion system 100 was in a start-up mode (below a temperature threshold) and sufficient to blow the flame off the start-up combustion holder 106 when the combustion system 100 was at an operating temperature (above the temperature threshold).

An electronic controller (not shown) can be operatively coupled to the fuel valve 114. The electronic controller may be configured to control a fuel flow rate output by the fuel nozzle 112. A sensor operatively coupled to the electronic controller and configured to sense a combustion volume attribute, can be operatively coupled to the electronic controller, and the electronic controller may be configured to control the fuel flow rate output by the fuel nozzle 112 responsive to feedback from the sensor. The sensor can include a temperature sensor.

The charge source 102 may be configured to apply a charge to the combustion fluid 104 with a charge concentration or density sufficient to cause the flame to be held by the start-up combustion holder 106 when the combustion system 100 is below the pre-determined temperature threshold and insufficient to cause the flame to be held by the start-up combustion holder 106 when the combustion system 100 is above the pre-determined temperature threshold.

According to embodiments, the start-up combustion holder 106 is configured to stably hold a flame during the combustion system 100 start-up process, and not to hold the flame after the start-up process is completed. It was found in experiments that cooling the start-up flame holder allowed easy adjustment of flame lift-off characteristics.

Figure 2:
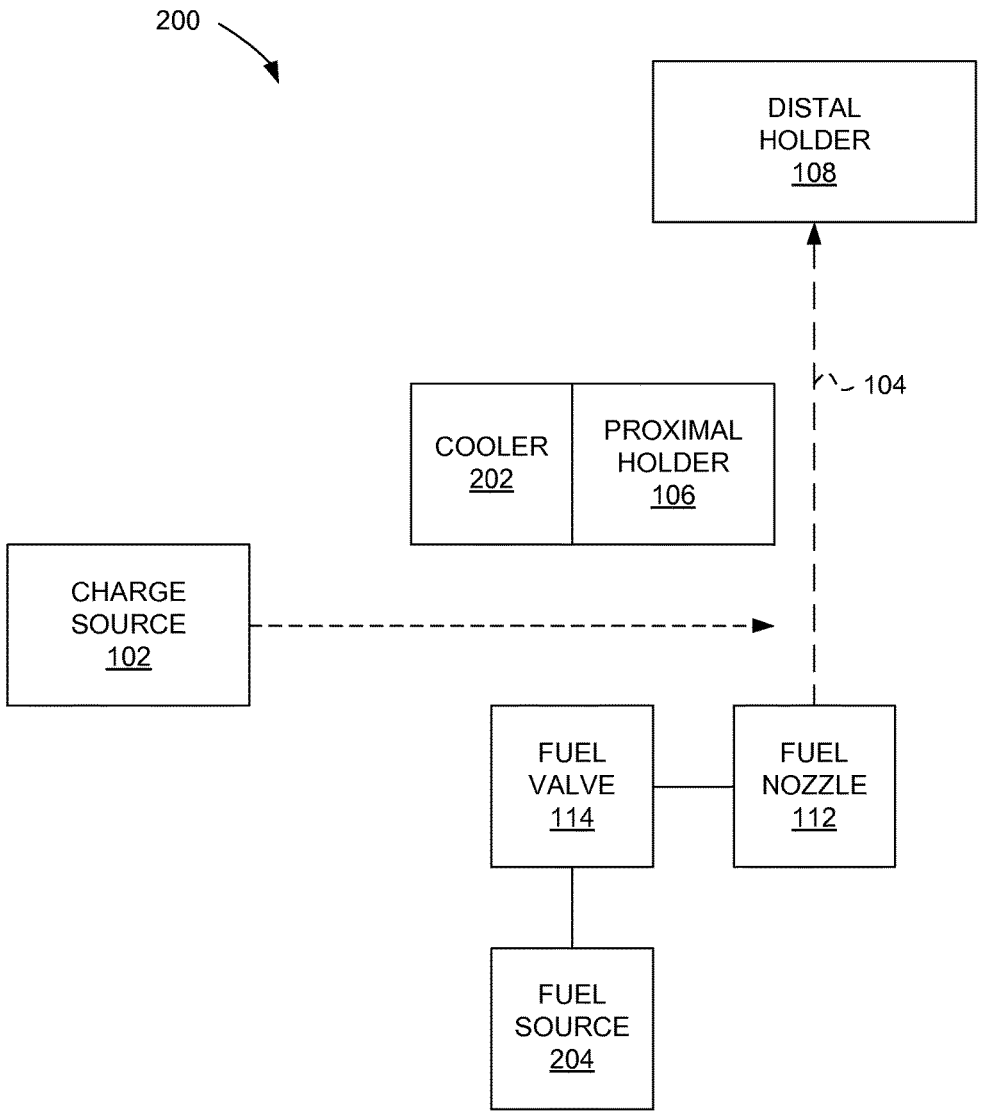
FIG. 2 is a block diagram of a combustion system configured for electrically assisted start-up, according to another embodiment.

FIG. 2 is a block diagram of a combustion system 200 configured for electrically assisted start-up, according to another embodiment. The combustion system 200 includes a cooler 202 operatively coupled to the start-up combustion holder 106. As shown in FIG. 2, the start-up combustion holder 106 may be referred to as a proximal holder. According to embodiments, the start-up combustion holder 106 can include all or portions of a pilot flame burner (not shown). The cooler 202 may be configured to apply cooling to the start-up combustion holder 106 sufficient to cause the start-up combustion holder 106 to hold the flame when the combustion system 200 is below the pre-determined temperature threshold, may be configured to increase a portion of a warm-up cycle during which the start-up combustion holder 106 holds the flame, and may be configured to increase a combustion volume temperature at which the start-up combustion holder 106 holds the flame. The cooler 202 can include an electronic controller operatively coupled and configured to control the cooler 202. A sensor can be operatively coupled to the electronic controller. The sensor may be configured to sense a combustion volume attribute. The electronic controller may be configured to control the cooler 202 responsive to feedback from the sensor. The cooler 202 can include a jacket configured to carry a cooling fluid, a phase-change heat transfer fluid, a refrigerator, a heat pipe, and/or a Peltier cooler.

Various fuel sources 204 are contemplated. Methane was used in experiments described herein. The inventors believe any fluid (gas or liquid) or fluidized (powdered coal, for example) fuel may be compatible with embodiments described herein.

Figure 3:
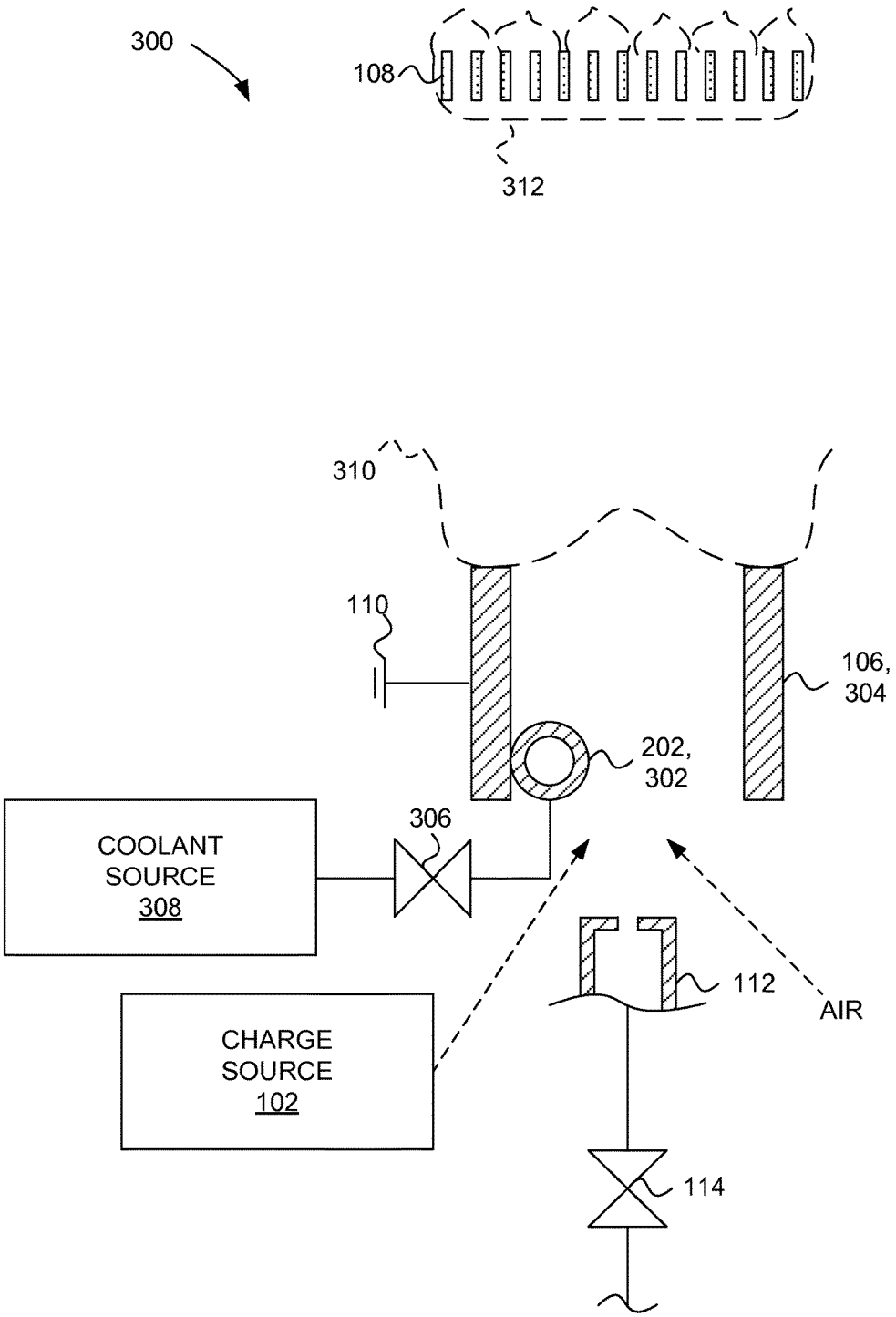
FIG. 3 is a diagram of a combustion system configured for electrically assisted start-up, according to another embodiment.

FIG. 3 is a diagram of a combustion system 300 configured for electrically assisted start-up, according to another embodiment. The combustion system 300 includes a cooler 202 with a coolant nozzle 302 configured to introduce a cooling fluid to the start-up combustion holder 106, 304. A coolant flow control apparatus 306 can be configured to control coolant flow from a coolant source 308. The coolant can include water and/or air. The flow control apparatus 306 can include a coolant flow control valve and may be configured for automatic operation to reduce or stop coolant flow when the combustion reaction is not held by the start-up combustion holder 106, 304. Additionally or alternatively, the flow control apparatus 306 may be configured for automatic operation to start or increase coolant flow to reestablish holding the flame by the start-up combustion holder 106, 304.

The apparatus 300 can hold a low temperature flame front 310 during start-up. After the apparatus 300 heats up, the flame lifts to a lifted flame front 312. In some embodiments, the flame was held with a raised flame holder 108. In an embodiment, the raised flame holder 108 was about three times the lateral extent of the start-up flame holder 304. FIG. 2 illustrates the raised flame holder 108 at a size that is compressed to fit the paper. The raised flame holder 108 was positioned about 27 inches above the top of the fuel nozzle 112.

Figure 4:
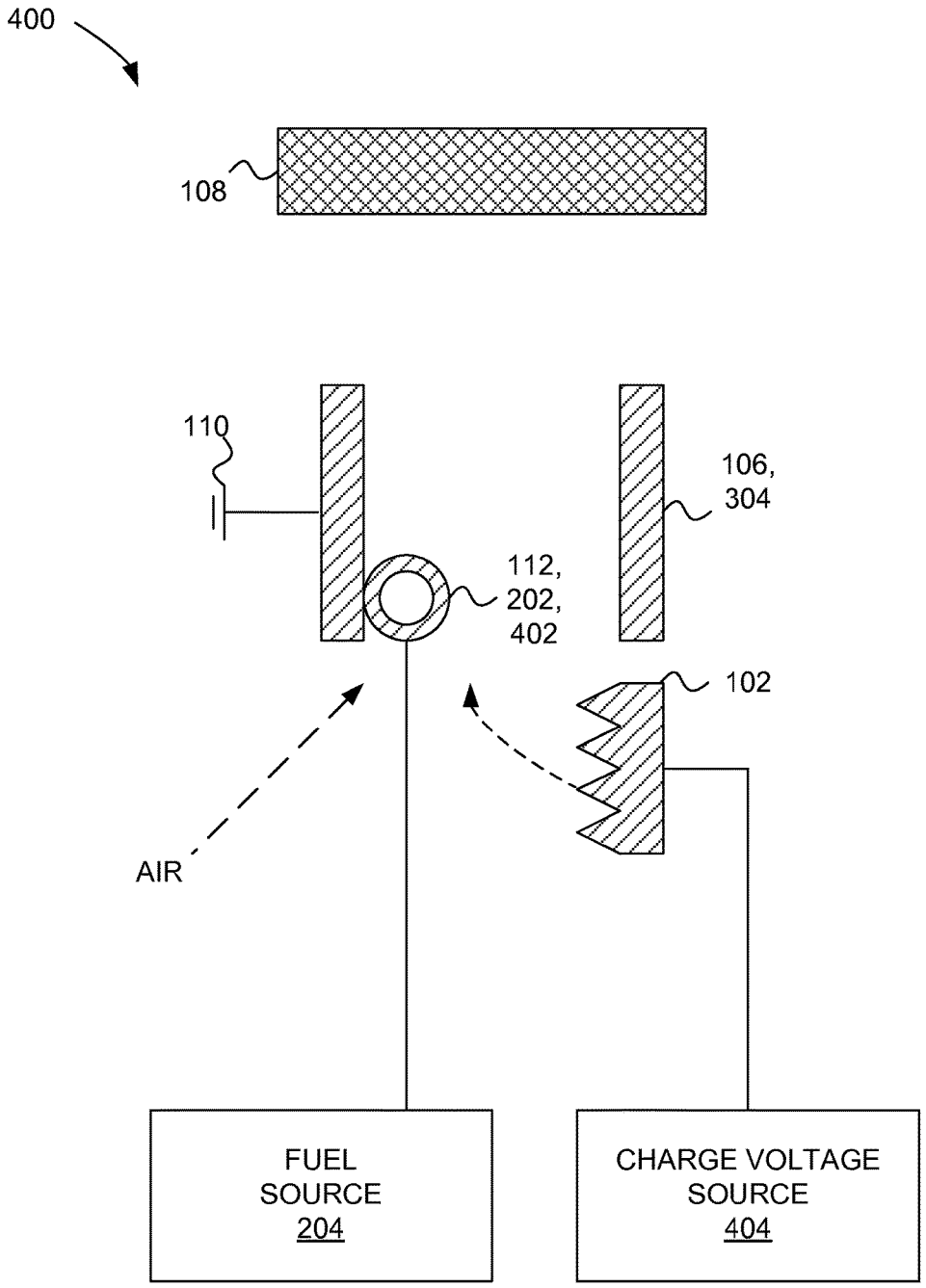
FIG. 4 is a diagram of a combustion system configured for electrically assisted start-up, according to another embodiment.

FIG. 4 is a diagram of a combustion system 400 configured for electrically assisted start-up, wherein the coolant includes fuel, according to another embodiment. The combustion system 400 includes a cooler 202. The cooler 202 includes a fuel nozzle 112, 402 configured to discharge a cooling fuel stream into the combustion fluid 104. Additionally or alternatively, the fuel nozzle 112, 402 may be configured to discharge a cooling fuel stream toward a surface of the start-up combustion holder 106, 304.

Figure 5:
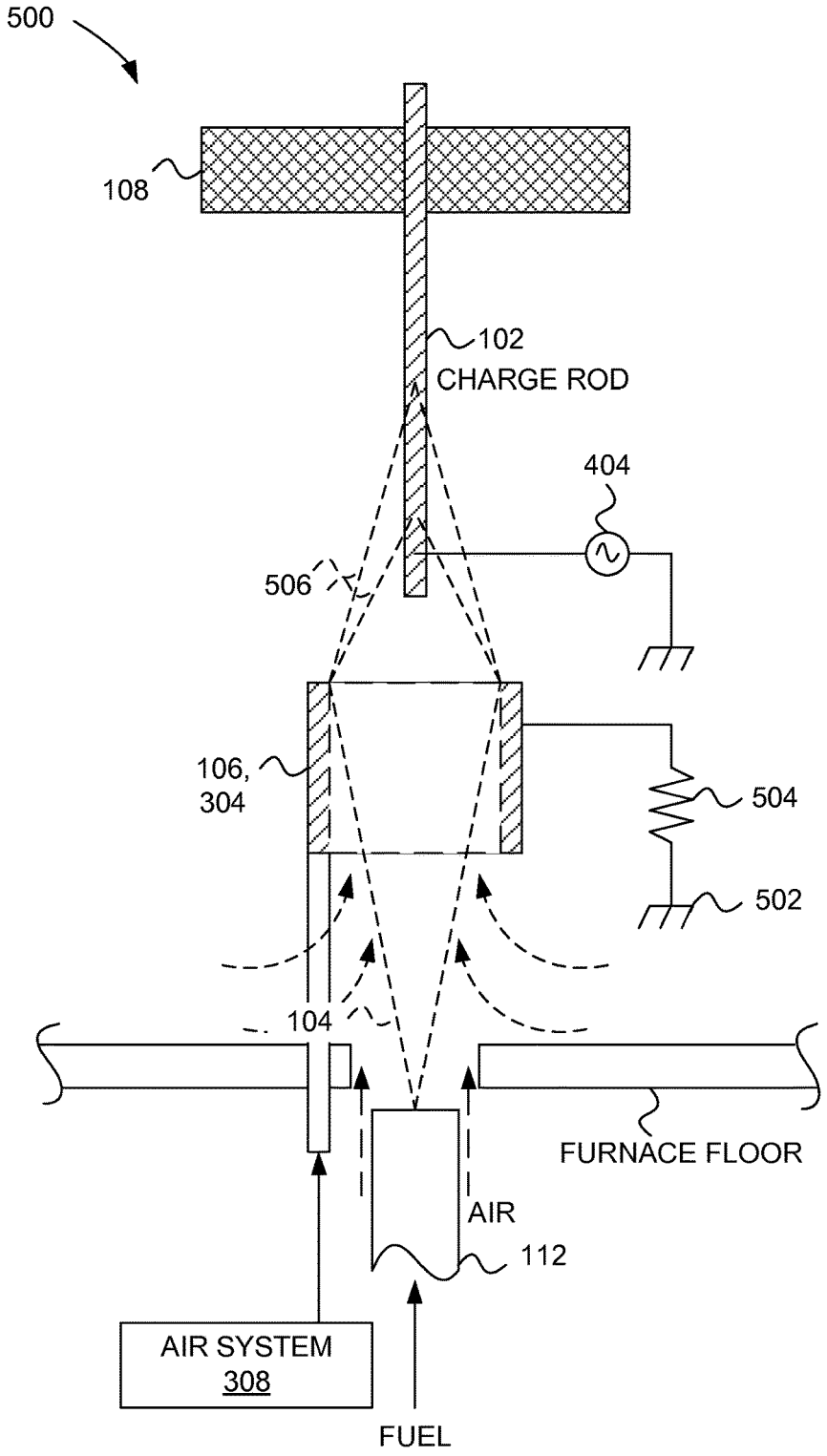
FIG. 5 is a diagram illustrating operation of a burner during a start-up state, according to an embodiment.

FIG. 5 is a diagram illustrating operation of a burner during a start-up state 500, according to an embodiment.

Figure 6:
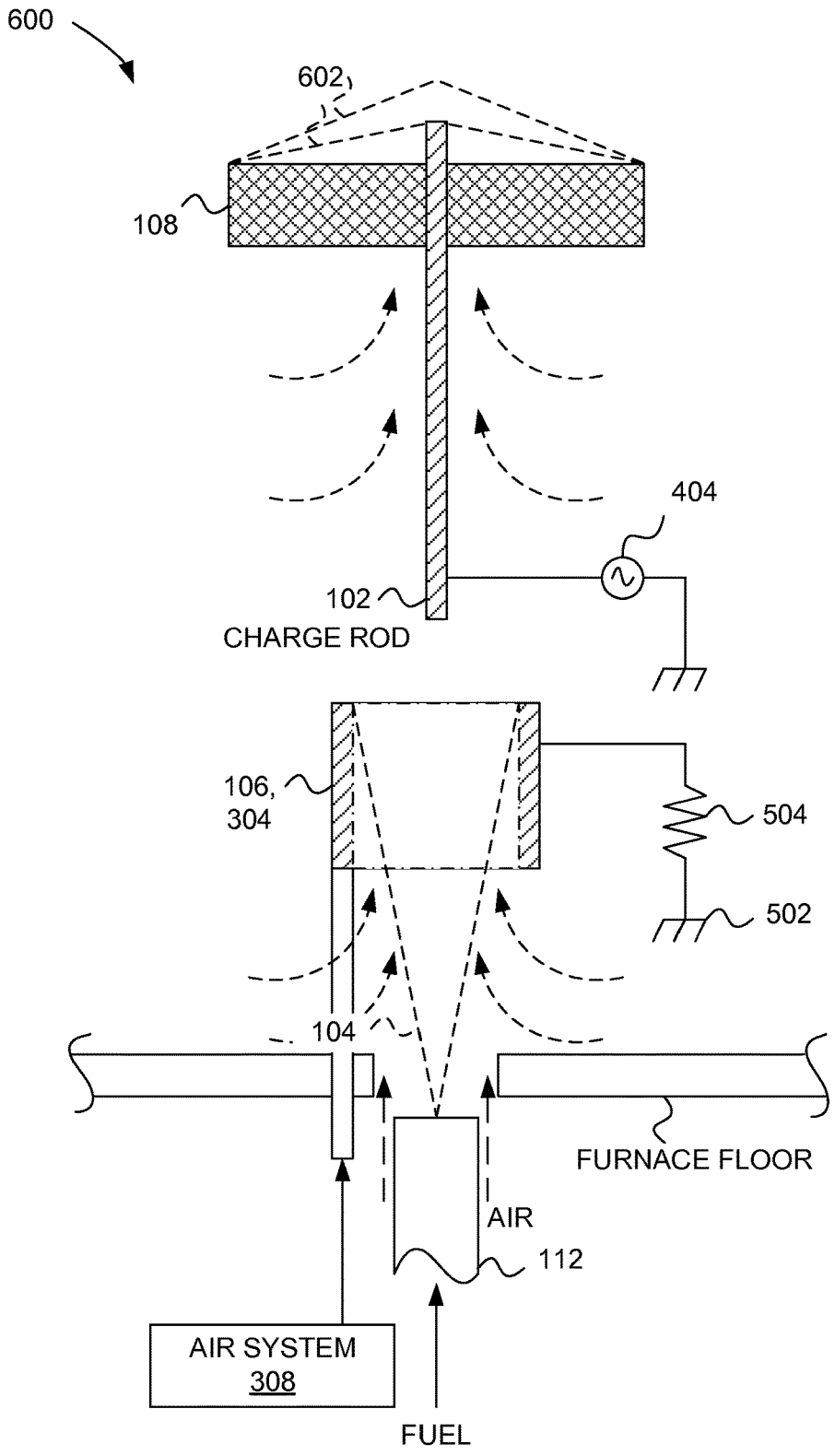
FIG. 6 is a diagram illustrating operation of a burner during an operational state, according to an embodiment.

FIG. 6 is a diagram illustrating operation of a burner during an operational state 600, according to an embodiment.

Referring to FIGS. 3 through 6, the start-up combustion holder 106, 304 can be configured as a hollow cylinder 304 disposed circumferentially to the combustion fluid 104. The charge source 102 can include a corona electrode disposed below the start-up combustion holder 106, 304. A charge voltage source 404 can be included and may be configured to apply a voltage to the charge source 102 to cause the charge source 102 to apply the electric charge to the combustion fluid 104. An electronic controller can be operatively coupled to the charge voltage source 404 and may be configured to control a voltage output by the charge voltage source 404 to the charge source 102. A sensor can be operatively coupled to the electronic controller and configured to sense a combustion volume attribute. The electronic controller may be configured to control the voltage output by the charge voltage source 404 to the charge source 102 responsive to feedback from the sensor. The sensor can include a temperature sensor.

A controller can reduce power consumption when the combustion system 100 is above the predetermined temperature threshold by stopping the application of voltage to the charge source 102 when the charge is not needed to cause the start-up combustion holder 106, 304 to hold the flame. Similarly, a controller can control fuel flow and/or distribute fuel flow between nozzles (e.g., between a fuel nozzle 112, 402 used as a cooler 202 and a fuel nozzle 112, 402 that substantially does not cool the start-up combustion holder 106, 304. However, it was found experimentally that an electronic controller was not needed to cause the combustion reaction to lift off the start-up combustion holder 106, 304. By manually selecting cooling fuel flow and using a given charging rate, it was found that the flame lifted from the start-up combustion holder 106, 304 at a desired time after ignition when the combustion reaction was stable. The inventors believe an increase in conductivity of the atmosphere the enclosed test burner at higher temperatures caused charges in the combustion fluid 104 to freely travel to grounded surfaces without corresponding anchoring of the flame.

Referring to FIGS. 5 and 6, the flame is raised to a charged state by a charge rod 102 suspended from a furnace ceiling through the raised flame holder 108. In one embodiment, the charge rod 102 is a 0.25 inch stainless steel tube. A voltage of between about 5000 volts and 40,000 volts is applied to the charge rod 102 by a voltage source 404. The voltage source 404 can be run at a DC voltage in one set of experiments with a current of about 100 millivolts. Alternatively, a time-varying voltage such as a chopped DC waveform or an AC voltage can alternatively be placed on the charge rod 102 or another charge source to apply a chopped DC or a temporally sign-varying majority charge to the flame. The fuel flow can be adjusted to result in a heat output of 500,000 to 1,000,000 BTU/hour, for example.

At relatively low temperatures the flame is held by the start-up flame holder 106, 304, which is in electrical continuity with a voltage ground 502 through a 4 to 10 megaohm resistor 504. In an embodiment, an 8 megaohm resistor 504 can be used. The start-up flame holder 106, 304 can optionally be formed as a plurality of segments (not shown) electrically isolated from one another and coupled to the voltage ground through a corresponding plurality (not shown) of resistors 504. The plural segment embodiment can be useful for maintaining electrical continuity with the flame while minimizing the incidence of electrical arc formation.

The apparatus 500, 600 can be installed in a refractory-lined furnace. An air damper (not shown) controls admission of combustion air through a furnace floor. For several minutes after flame ignition, the flame 506 is held by the start-up flame holder 106, 304, as depicted in FIG. 5. The flame height varies but the flame 506 is very stable.

After several minutes, the furnace approaches an equilibrium temperature. The flame lifts to be held by the raised flame holder 108 as a lifted flame 602. The lifted flame operating state 600 is depicted in FIG. 6. The voltage source 404 can optionally be shut down after the furnace reached the operational state 600.

In the operating state 600, additional air and/or flue gas is mixed with fuel or a premixed rich mixture output by the fuel nozzle 112. The additional dilution results in a lean burning flame 602 that can output less than 8 parts per million oxides of nitrogen (NOx), primarily as NO, at a flue oxygen concentration of 2% to 4%.

The apparatus depicted in FIGS. 1-6 exhibits high flame stability during start-up 500 and exhibits low NOx output during operation 600. The inventors operated the system 100, 200, 300, 400, 500, 600 using a pure fuel nozzle 112 in some experiments and with a premix nozzle 112 in other experiments. In a premix embodiment, damper air (illustrated passing through the furnace floor in FIGS. 5 and 6) can be shut off.

With respect to the air system 308, increased cooling air can result in a higher flame lifting temperature and decreased cooling air can result in a lower flame lifting temperature, as determined from an amount of time between flame ignition and flame lifting to the raised flame holder 108.

Figure 7:
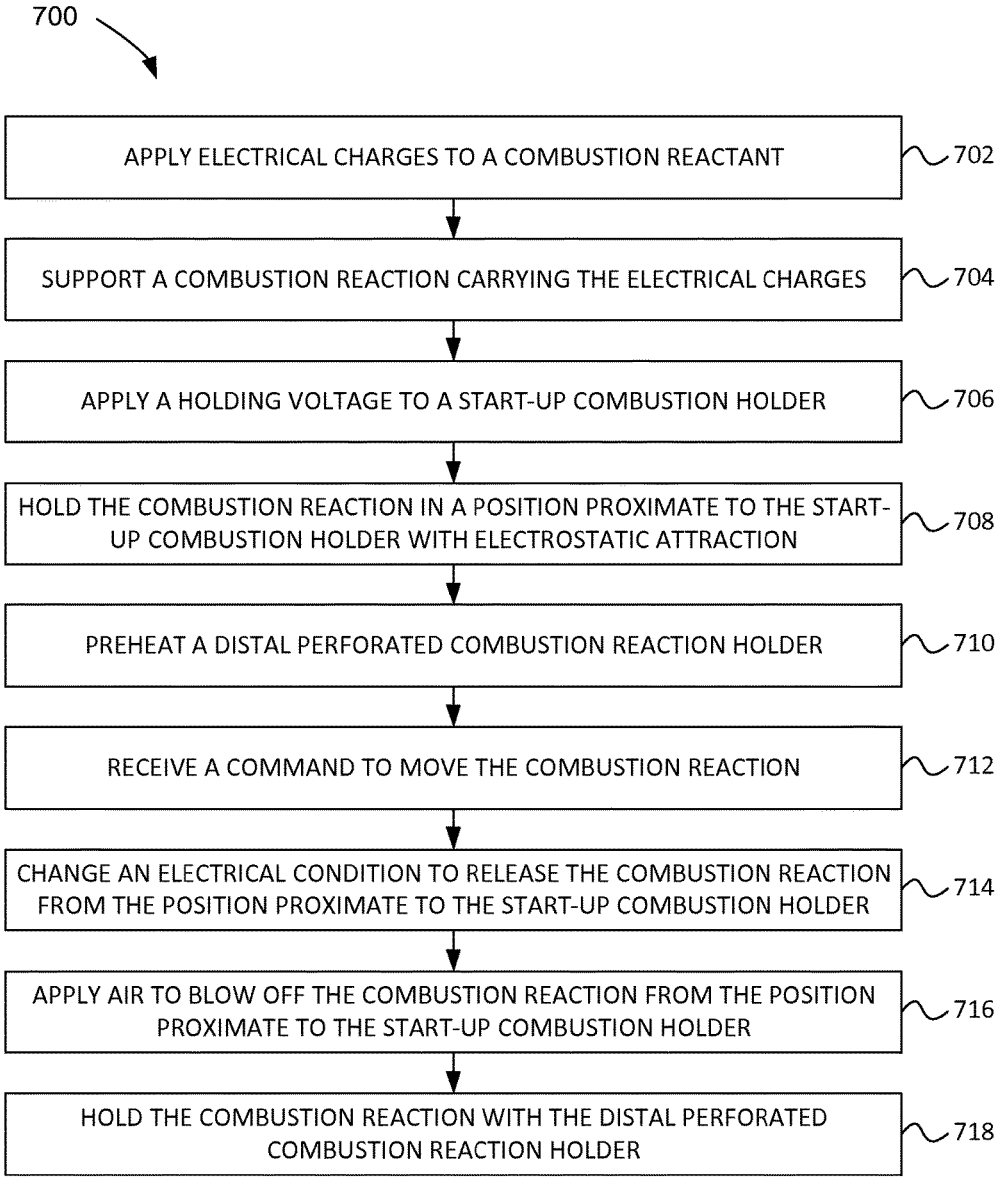
FIG. 7 is a flow chart showing a method for electrically assisted start up of a distal flame holder, according to an embodiment.
Figure 8:
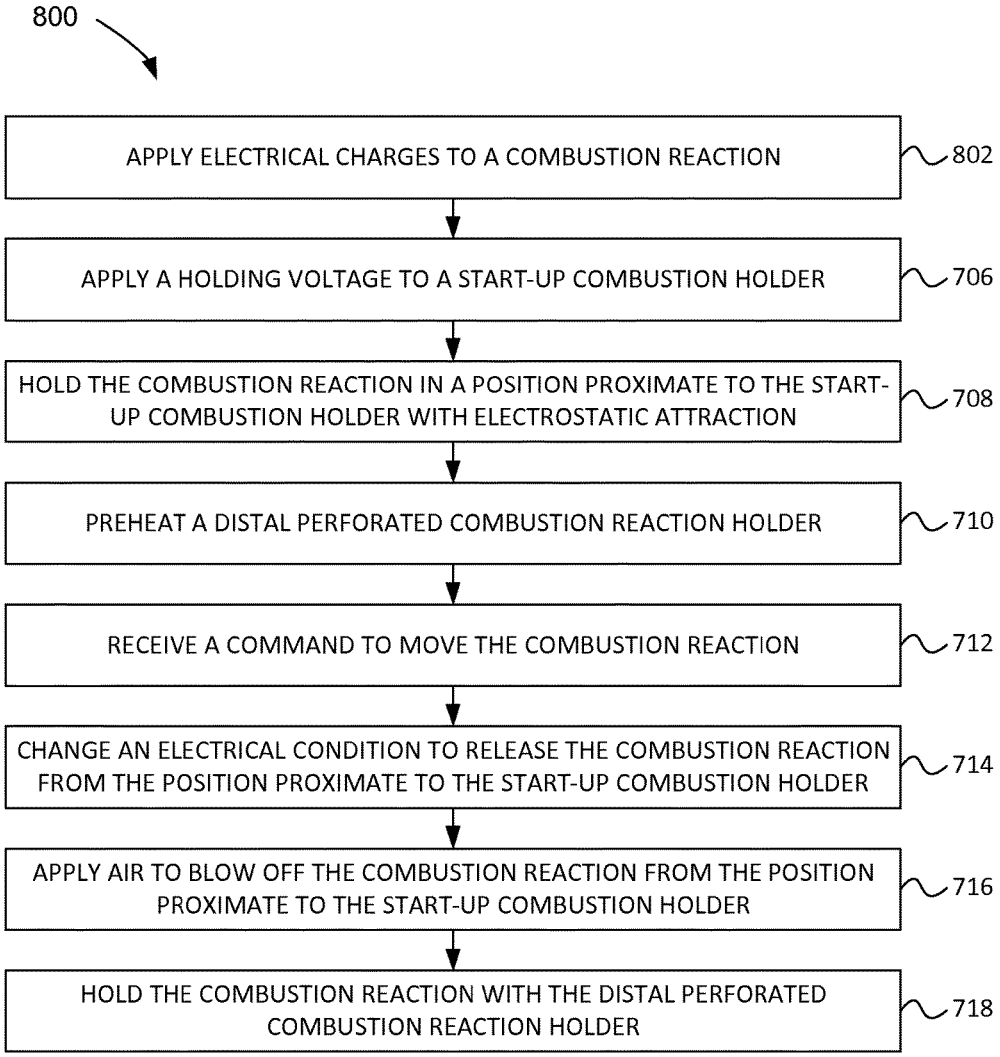
FIG. 8 is a flow chart showing a method for electrically assisted start up of a distal flame holder, according to another embodiment.

FIG. 7 is a flow chart showing a method for electrically assisted start up of a distal flame holder, according to an embodiment. FIG. 8 is a flow chart showing a method for electrically assisted start up of a distal flame holder, according to another embodiment. The primary difference between the methods of FIG. 7 and FIG. 8 is related to where and how charges are applied to a combustion reaction.

Referring to FIG. 7, according to an embodiment, a method 700 for operating a combustion system begins with step 702 wherein an electric charge source is operated to apply electric charges to a combustion reactant. Proceeding to step 704, a combustion reaction is supported with the combustion reactant. The combustion reaction carries the electric charges carried to the combustion reaction by the combustion reactant. In step 706, a holding voltage is applied to a start-up combustion holder such that the electric charges carried by the combustion reactant and combustion reaction are electrically attracted to the holding voltage carried by the start-up combustion holder. Proceeding to step 708, the combustion reaction is held in a position proximate to the start-up combustion holder responsive to the attraction of the electric charges to the start-up combustion holder.

Operating an electric charge source to apply electric charges to the combustion reactant in step 702 can include operating an ionizer to output charged particles to the combustion reactant. For example, step 702 can include applying electric charges to a fuel, to an oxidant (such as combustion air carrying oxygen), or applying electric charges to a mixture of fuel and oxidant. The electric charges applied to the combustion reactant can be positive or negative depending on electrical polarity of the electric charge source.

Operating an electric charge source in step 702 to apply electric charges to a combustion reactant can include operating a power supply to output at least 10 kilovolts. For example, the power supply can output between 15 and 80 kilovolts. Operating an electric charge source to apply electric charges to a combustion reactant can include applying an AC electrical signal to a voltage multiplier, and multiplying the voltage to output at least 10 kV on an output node. In another embodiment, operating an electric charge source to apply electric charges to a combustion reactant includes applying a rectified signal to a transformer, and inducing a voltage of at least 10 kV on an output node. In another embodiment, operating an electric charge source to apply electric charges to a combustion reactant includes operating a switching power supply to apply a regulated voltage of at least 10 kV on an output node.

Referring to step 706, applying a holding voltage to a start-up combustion holder can include making continuity between the start-up combustion holder and a voltage ground. Either positive or negative charges, or alternating positive and negative charges can be attracted to discharge through the voltage ground held by the start-up combustion holder. In another embodiment, applying a holding voltage to a start-up combustion holder includes applying a holding voltage opposite in polarity to the electrical charges carried by the combustion reaction to the start-up combustion holder. The inventors have found that, while either polarity can work, positive charges applied to the combustion reaction can be somewhat more effective than negative charges applied to the combustion reaction for holding the combustion reaction proximate to the start-up combustion holder.

Proceeding to step 710, a distal perforated combustion reaction holder can be preheated with the combustion reaction held in the position proximate to the start-up combustion holder. Distal perforated combustion reaction holders are described in more detail in PCT Application No. PCT/US2014/016632, entitled "FUEL COMBUSTION SYSTEM WITH A PERFORATED REACTION HOLDER" filed on Feb. 14, 2014; which is incorporated by reference herein.

Optionally, as indicated in step 712, a command to move the combustion reaction from the position proximal to the start-up combustion holder to a distal combustion reaction holder can be received. In other embodiments, the inventors have found that the combustion reaction can be made to release from the start-up combustion holder once the distal perforated reaction holder has been preheated. After the combustion reaction in the position proximate to the start-up combustion holder pre-heats the perforated combustion reaction holder, the combustion reaction can be allowed to detach from the start-up combustion holder.

Proceeding to step 714, an electrical condition can be changed to cause the combustion reaction to not be held in the position proximate to the start-up combustion holder. The method then proceeds to step 718, wherein the combustion reaction is held with the perforated distal combustion reaction holder.

Changing the electrical condition to cause the combustion reaction to not be held in the position proximate to the start-up combustion holder in step 718 can include stopping the application of electrical charges to the combustion reactant and/or breaking continuity between the holding voltage and the start-up combustion holder.

Optionally, other approaches can be used to augment the release of the combustion reaction from the start-up combustion reaction holder. For example, as shown in step 716, after the combustion reaction in the position proximate to the start-up combustion holder pre-heats the perforated combustion reaction holder, air can be applied proximate to the start-up combustion holder to blow the combustion reaction off the position proximate to the start-up combustion holder.

Referring to FIG. 8, a method 800 for operating a combustion system begins with step 802, wherein an electric charge source is operated to apply electric charges to a combustion reaction. The method further includes step 706, wherein a holding voltage is applied to a start-up combustion holder such that the electric charges carried by the combustion reaction are electrically attracted to the holding voltage carried by the start-up combustion holder. In step 708, the combustion reaction is held in a position proximate to the start-up combustion holder responsive to the attraction of the electric charges to the start-up combustion holder.

In step 802, operating an electric charge source to apply electric charges to the combustion reaction can includes placing a high voltage on a charge electrode at least partially immersed in the combustion reaction. Additionally or alternatively, step 802 can include operating an ionizer to output charged particles to the combustion reaction.

Operating an electric charge source to apply electric charges to a combustion reaction can include operating a power supply to output at least 10 kilovolts such as, for example, between 15 and 80 kilovolts. The applied voltage can be DC or AC.

Other aspects of the method 800 are similar to the method 700 described above in conjunction with FIG. 7.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a charge source configured to apply an electric charge to a combustion fluid;

a start-up combustion holder configured to attract the electric charge and hold a flame when the combustion system is below a pre-determined temperature threshold and to not hold the flame when the combustion system is above the pre-determined temperature threshold; and a raised flame holder spaced apart from the start-up combustion holder and configured to hold the combustion reaction when the combustion system is above the pre-determined temperature threshold, wherein the raised flame holder includes a body defining a plurality of perforations extending through the body.

2. The combustion system of claim 1, wherein the raised flame holder includes a high temperature ceramic honeycomb.

3. The combustion system of claim 1, wherein the raised flame holder includes a cordierite honeycomb.

4. The combustion system of claim 1, wherein the raised flame holder includes an alumina honeycomb.

5. The combustion system of claim 1, wherein the raised flame holder includes a ceramic honeycomb having channels of about 1.99 mm to 5 mm square sectional size.

6. The combustion system of claim 1, wherein the raised flame holder further comprises:

a honeycomb sheet having a thickness of about 0.5 inches to 4 inches.

7. The combustion system of claim 6, wherein the raised flame holder further comprises:

a honeycomb sheet having a thickness of about 2 inches.

8. The combustion system of claim 1, wherein the combustion fluid includes a fuel stream.

9. The combustion system of claim 1, wherein the combustion fluid includes the flame.

10. The combustion system of claim 1, wherein the combustion fluid includes combustion air.

11. The combustion system of claim 1, wherein the combustion fluid includes flue gas.

12. The combustion system of claim 1, further comprising:

a holding voltage source operatively coupled to the start-up combustion holder and configured to substantially maintain the start-up combustion holder at a charge attracting voltage potential.

13. The combustion system of claim 12, wherein the holding voltage source includes an electrical node corresponding to a voltage ground.

14. The combustion system of claim 12, wherein the holding voltage source includes a voltage source configured to output a voltage opposite in polarity from the electric charge with which the combustion fluid is imbued.

15. The combustion system of claim 12, wherein the holding voltage source is configured to hold the start-up combustion holder at a voltage potential sufficient to hold the flame when the combustion system is below the pre-determined temperature threshold.

16. The combustion system of claim 12, further comprising:

an electronic controller operatively coupled to the holding voltage source and configured to control the holding voltage applied to the start-up combustion holder.

17. The combustion system of claim 16, further comprising:

a sensor operatively coupled to the electronic controller and configured to sense a combustion volume attribute.

18. The combustion system of claim 17, wherein the electronic controller is configured to control the voltage output by the charge voltage source to the charge source responsive to feedback from the sensor.

19. The combustion system of claim 17, wherein the sensor includes a temperature sensor.

20. The combustion system of claim 1, further comprising:

a fuel nozzle configured to output a fuel stream.

21. The combustion system of claim 20, further comprising:

a fuel valve operatively coupled to the fuel nozzle and configured to control a flow of fuel.

22. The combustion system of claim 20, wherein the fuel valve is configured to allow a fuel stream velocity from the fuel nozzle insufficient to blow the flame off the start-up combustion holder when the combustion system is below the pre-determined temperature threshold.

23. The combustion system of claim 20, wherein the fuel valve is configured to allow a fuel stream velocity from the fuel nozzle sufficient to blow the flame off the start-up combustion holder when the combustion system is above the pre-determined temperature threshold.

24. The combustion system of claim 20, further comprising:

an electronic controller operatively coupled to the fuel valve and configured to control a fuel flow rate output by the fuel nozzle.

25. The combustion system of claim 24, further comprising:

a sensor operatively coupled to the electronic controller and configured to sense a combustion volume attribute.

26. The combustion system of claim 25, wherein the electronic controller is configured to control the fuel flow rate output by the fuel nozzle responsive to feedback from the sensor.

27. The combustion system of claim 25, wherein the sensor includes a temperature sensor.

28. The combustion system of claim 1, wherein the charge source is configured to apply a charge density to the combustion fluid sufficient to cause the flame to be held by the start-up combustion holder when the combustion system is below the pre-determined temperature threshold.

29. The combustion system of claim 1, wherein the charge source is configured to apply a charge density to the combustion fluid insufficient to cause the flame to be held by the start-up combustion holder when the combustion system is above the pre-determined temperature threshold.

30. The combustion system of claim 1, further comprising:

a cooler operatively coupled to the start-up combustion holder.

31. The combustion system of claim 30, wherein the cooler is configured to apply cooling to the start-up holder sufficient to cause the start-up holder to hold the flame when the combustion system is below the pre-determined temperature threshold.

32. The combustion system of claim 30, wherein the cooler is configured to increase a portion of a warm-up cycle during which the start-up combustion holder holds the flame.

33. The combustion system of claim 30, wherein the cooler is configured to increase a combustion volume temperature at which the start-up combustion holder holds the flame.

34. The combustion system of claim 33, further comprising:

an electronic controller operatively coupled to and configured to control the cooler.

35. The combustion system of claim 33, further comprising:

a sensor operatively coupled to the electronic controller and configured to sense a combustion volume attribute.

36. The combustion system of claim 35, wherein the electronic controller is configured to control the cooler responsive to feedback from the sensor.

37. The combustion system of claim 30, wherein the cooler includes a jacket configured to carry a cooling fluid.

38. The combustion system of claim 1, further comprising:

a cooler including a coolant nozzle configured to introduce a cooling fluid to the start-up combustion holder.

39. The combustion system of claim 38, wherein the cooler further comprises:

a flow control apparatus configured to control a flow of the coolant from a coolant source.

40. The combustion system of claim 39, wherein the flow control apparatus is configured for automatic operation to reduce or stop coolant flow when the combustion reaction is not held by the start-up combustion holder.

41. The combustion system of claim 39, wherein the flow control apparatus is configured for automatic operation to start or increase coolant flow to reestablish holding the flame by the start-up combustion holder.

42. The combustion system of claim 1, wherein the start-up holder is configured as a hollow cylinder disposed circumferentially to the combustion fluid.

43. The combustion system of claim 1, wherein the charge source includes a corona electrode disposed below the start-up combustion holder.

44. The combustion system of claim 1, further comprising:

a charge voltage source configured to apply a voltage to the charge source to cause the charge source to apply the electric charge to the combustion fluid.

45. The combustion system of claim 44, further comprising:

an electronic controller operatively coupled to the charge voltage source and configured to control a voltage output by the charge voltage source to the charge source.

* * * * *